US006622929B1

(12) United States Patent
Levitin et al.

(10) Patent No.: US 6,622,929 B1
(45) Date of Patent: Sep. 23, 2003

(54) STEAM HEATING SYSTEM

(76) Inventors: Mikhail Levitin, P.O. Box 102, Reeders, PA (US) 18352; Boris Khaytin, P.O. Box 102, Reeders, PA (US) 18352

( * ) Notice: Subject to any disclaimer, the term of this patent is extended or adjusted under 35 U.S.C. 154(b) by 0 days.

(21) Appl. No.: 09/781,204

(22) Filed: Feb. 13, 2001

(51) Int. Cl.[7] ..... F24H 3/06
(52) U.S. Cl. ..... 237/16; 237/2 A; 237/2 R
(58) Field of Search ..... 237/2 R, 7, 8 A, 237/16, 2 A; 137/624.11

(56) References Cited

U.S. PATENT DOCUMENTS 1,174,714 A * 3/1916 Harrison ..... 237/7
3,236,292 A * 2/1966 Smith, Jr. ..... 137/1
3,610,523 A * 10/1971 Troy ..... 237/59
3,886,998 A * 6/1975 Rowekamp ..... 165/2
4,052,001 A * 10/1977 Vogt ..... 237/1 A
4,545,524 A * 10/1985 Zelczer ..... 236/46 R
4,585,054 A * 4/1986 Koprunner ..... 165/112
4,613,071 A * 9/1986 Omori ..... 237/9 R
4,702,412 A * 10/1987 Zelczer et al. ..... 236/46 R
5,125,572 A * 6/1992 Piegari ..... 237/8 R
5,441,070 A * 8/1995 Thompson ..... 137/1
5,707,007 A * 1/1998 Fiedrich ..... 237/8 R

FOREIGN PATENT DOCUMENTS

CH 1 208 559 * 8/1969

* cited by examiner

*Primary Examiner*—Derek Boles

(57) ABSTRACT

The present invention increases the efficiency of a heat distribution system, and more specifically steam heating systems designed to maintain a constant temperature in a relatively large space by distributing the steam through pipes assembled with timers to control automatically activated valves installed on the pipes.

2 Claims, 1 Drawing Sheet

STEAM HEATING SYSTEM

FIELD OF THE INVENTION

The present invention relates to a steam heating system, and more specifically to a steam heating system designed to maintain a constant temperature in a relatively large space, i.e. in a building using one or more radiators, which may be found in a single apartment.

THE PRIOR ART

Convectional steam heating systems of the single dwelling, single zone type are notoriously inefficient in that the temperature in the space is rarely maintained at or near a desired set point. Typical systems of the type described employ a thermostat in the space to be heated, which controls a fuel burner, which in turn heats a boiler. Upon demand for heat at the thermostat, steam is generated in the boiler and as the steam pressure increases the steam enters the piping system forcing cool air through the thermostatic vent valves. These valves allow the cool air within the radiators and piping system to vent to the atmosphere and close when steam enters the radiators. After venting of the air, the hot steam heats the radiators, which continue to emit heat to the space. The burner continues to function until the temperature setting of the thermostat is reached. At this point the burner is deactivated. A significant drawback of such conventional systems resides in the fact that different amount of steam enters each of the parallel-connected radiators. As a result, there are different temperatures in the spaces heated by each radiator.

Numerous control systems have been proposed which incorporate complex valving, multiple sensors, etc, in an attempt to provide a relatively constant temperature within one or more spaces to be heated. Such assemblies have been expensive because of their complexity, prone to problems, and generally unsuited to simple single zone applications.

Accordingly, a need exists for improving the steam heating system with regard to providing a relatively constant temperature within one or more spaces to be heated.

SUMMARY OF THE INVENTION

The present invention may be summarized as applied to a steam heating system, which maintains a relatively constant temperature within one or more spaces to be heated. In accordance with the invention a conventional heating assembly includes a boiler, a thermostat to regulate heating by the boiler, and a distributive collector. It also includes radiators connected to the distributive collector, which is provided with an automatically activated valve that is installed between the radiator and the distributive collector. A timer, which energizes the automatically activated valve, is connected electrically to the thermostat.

When the thermostat demands heat, the boiler is energized and remains functional while the radiators have been heated by steam. After a while the timer energizes and automatically activates the valves and closes them. Steam cannot enter and heat these radiators, but other radiators remain heated by steam until the thermostat set point is reached and the burner of the boiler is deactivated. At the same time the thermostat deactivates the timer and simultaneously automatically activates one or more valves and opens them. The condensation returns to the boiler.

By running the boiler on a series of short cycles as opposed to continuously, as in conventional heating systems, there are similar temperatures in the spaces heated by each radiator.

The above described and many other features and attendant advantages of the present invention will become apparent as the invention becomes better understood by reference to the following detailed description when considered in conjunction with the accompanying drawing.

DESCRIPTION OF THE DRAWING

A detailed description of the preferred embodiment of the invention will be made with reference to the accompanying drawing.

Figure 1:
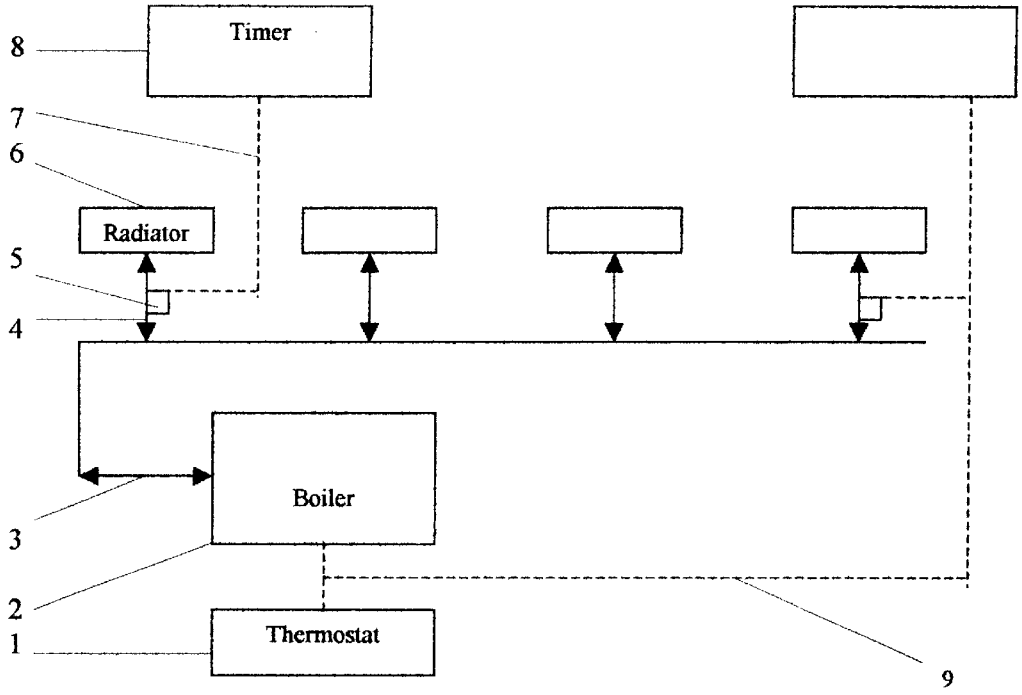
FIG. 1 shows a block diagram of the steam heating system in accordance with the preferred embodiment of the present invention.

The above described and many other features and attendant advantages of the present invention will become apparent as the invention becomes better understood by reference to the following detailed description when considered in conjunction with the accompanying drawings.

DETAILED DESCRIPTION OF THE DRAWING

The following is a detailed description of the best presently known mode of carrying out the invention. This description is not to be taken in a limiting sense, but is made merely for the purpose of illustrating the general principles of the invention. The scope of the invention is defined by the appended claims.

The steam heating system (see FIG. 1) is comprised of a boiler 2 with a thermostat 1, a distributive collector 3 connected to the boiler 2, a pipe 4 connected to the distributive collector 3 with radiator 6, and an automatically activated valve 5, which is normally open. This valve is installed between the radiator and the distributive collector. The system also is comprised of a timer 8, which is electrically connected with the automatically activated valve 5 by line 7 and to the thermostat 1 by line 9.

When the thermostat 1 calls for heat the boiler 2 is energized and steam discharges from the boiler 2 through the distributive collector 3 and pipe 4 to the radiator 6 and heats it. When the set point is reached, the timer 8 energizes the automatically activated open valve 5 and closes it. Thus the steam cannot enter the radiator 6, but it continues to enter another radiator and heats it with steam until the thermostat 1 set point is reached and the burner of the boiler 2 is deactivated. At the same time the thermostat 1 deactivates the timer 8 and simultaneously automatically activates valve 5 and opens it. The condensation returns to the boiler.

By running the boiler 2 on a series of short cycles as opposed to continuously, as in conventional heating systems, there are similar temperatures in the spaces heated by each radiator 6.

Figure 2:
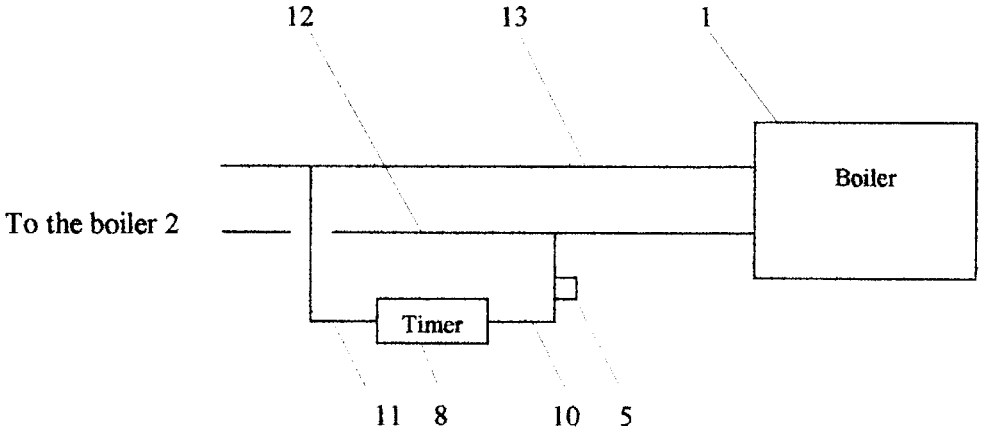
FIG. 2 shows a circuit diagram of the steam heating system in accordance with the preferred embodiment of the present invention.

According to the circuit diagram (see FIG. 2) the automatically activated valve 5 is connected in a series with timer 8 that in turn is connected by lines 10 and 11 to lines 12 and 13, which are connected to thermostat 1 to the boiler 2. When the thermostat 1 calls for heat, lines 12 and 13 are energized. At the set point the timer 8 energizes the automatically activated open valve 5 and closes it, but boiler 2 continues to function. When the thermostat 1 set point is reached the burner of the boiler 2 is deactivated. At the same time the thermostat 1 is deactivated the timer 8, simultaneously activates valve 5 and opens it. The condensation returns to the boiler.

Although the present invention has been described in terms of the preferred embodiment above, numerous modifications and/or additions to the above described preferred embodiment would be readily apparent to one skilled in the art. It is intended that the scope of the present invention extends to modifications and/or additions and that the scope of the present invention is limited solely by the claims set forth below.

What is claimed:

1. A steam heating system comprised of a boiler, a thermostat which senses boiler temperature and regulates a burner of said boiler, a distributive collector said boiler, a radiator connected to said distributive collector by a pipe for feeding steam to said radiator and returning condensate to said boiler through said distributive collector, an automatically activated valve installed on said pipe, a timer which electrically activated said normally open valve after a period of time to close said normally open automatically activated valve, said thermostat having a set point wherein the burner of the boiler and the timer is deactivated such that said automatically activated valve returns to said normally open position allowing the condensate to return to the boiler.

2. A steam heating system according to claim 1 while an automatically activated valve is opened when a boiler is not operating.

* * * * *